US010743613B2

(12) United States Patent
Farris et al.

(10) Patent No.: US 10,743,613 B2
(45) Date of Patent: Aug. 18, 2020

(54) SOLE STRUCTURE WITH PISTON AND ADAPTIVE CUSHIONING SYSTEM

(71) Applicant: Nike, Inc., Beaverton, OR (US)

(72) Inventors: Bryan N. Farris, North Plains, OR (US); Austin Orand, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 264 days.

(21) Appl. No.: 15/814,771

(22) Filed: Nov. 16, 2017

(65) Prior Publication Data

US 2018/0140045 A1 May 24, 2018

Related U.S. Application Data

(60) Provisional application No. 62/424,891, filed on Nov. 21, 2016.

(51) Int. Cl.

| | |
|---|---|
| ***A43B 13/18*** | (2006.01) |
| ***A43B 13/20*** | (2006.01) |
| *A43B 13/14* | (2006.01) |
| *A43B 3/00* | (2006.01) |

(52) U.S. Cl.

CPC ..... *A43B 13/187* (2013.01); *A43B 13/181* (2013.01); *A43B 13/189* (2013.01); *A43B 13/20* (2013.01); *A43B 3/0015* (2013.01); *A43B 13/14* (2013.01); *A43B 13/141* (2013.01)

(58) Field of Classification Search

CPC ... A43B 13/186; A43B 13/187; A43B 13/188; A43B 13/189; A43B 13/203; A43B 13/20

See application file for complete search history.

(56) References Cited

U.S. PATENT DOCUMENTS

| | | | | |
|---|---|---|---|---|
| 5,517,769 | A | 5/1996 | Zhao | |
| 5,537,762 | A * | 7/1996 | Walters | A43B 13/203 36/28 |
| 5,813,142 | A | 9/1998 | Demon | |
| 5,813,145 | A | 9/1998 | Prober | |
| 6,237,255 | B1 | 5/2001 | Renaudin et al. | |
| 6,305,102 | B1 * | 10/2001 | Doyle | A43B 13/203 36/29 |
| 6,718,655 | B2 | 4/2004 | Sugawara | |
| 7,188,439 | B2 | 3/2007 | DiBenedetto et al. | |
| 7,225,565 | B2 | 6/2007 | DiBenedetto et al. | |

(Continued)

FOREIGN PATENT DOCUMENTS

EP 2848139 A1 3/2015

OTHER PUBLICATIONS

G3 Expedition Skins, http://www.amazon.com/gp/product/B014W63IWY?keywords=ski%20skins&qid=1450397381&ref_=sr_1_1&sr=8-1, accessed Nov. 15, 2017.

*Primary Examiner* — Megan E Lynch
(74) *Attorney, Agent, or Firm* — Quinn IP Law

(57) ABSTRACT

A sole structure for an article of footwear has a sole plate with a foot-facing surface. A piston is disposed on the sole plate at the foot-facing surface. The sole structure includes a cushioning system disposed on the sole plate. The cushioning system has a variable cushioning characteristic, such as hardness or viscosity. The piston deforms the cushioning system and the variable cushioning characteristic varies in response to dorsiflexion of the sole plate.

12 Claims, 9 Drawing Sheets

(56) References Cited

U.S. PATENT DOCUMENTS 7,917,981 B1* 4/2011 Lakic ..... A43B 17/035 12/142 R
8,161,667 B2 4/2012 Hwang
8,186,081 B2 5/2012 Wilson, III et al.
8,312,647 B2 11/2012 Hofmann
8,567,097 B2 10/2013 Edy et al.
8,872,362 B2* 10/2014 Lee ..... A43B 3/0015 290/1 A
9,119,437 B2 9/2015 Weller et al.
9,480,302 B2 11/2016 Freschi
9,668,541 B2 6/2017 Lee et al.
2002/0035794 A1* 3/2002 Doyle ..... A43B 13/203 36/29
2003/0005600 A1 1/2003 Kita
2003/0188460 A1* 10/2003 Dubner ..... A43B 7/144 36/156
2004/0064974 A1* 4/2004 Schuster ..... A43B 1/0045 36/91
2005/0000115 A1 1/2005 Kimura et al.
2006/0021261 A1 2/2006 Face
2007/0094890 A1* 5/2007 Cho ..... A43B 7/081 36/3 B
2007/0209231 A1* 9/2007 Wu ..... A43B 13/186 36/27
2008/0296871 A1 12/2008 Hsieh
2009/0265958 A1 10/2009 DiBenedetto et al.
2010/0058613 A1 3/2010 Im
2010/0071231 A1 3/2010 Murphy et al.
2010/0242303 A1* 9/2010 Callahan ..... A43B 13/203 36/28
2011/0067264 A1* 3/2011 Doyle ..... A43B 13/203 36/29
2011/0107618 A1* 5/2011 Kim ..... A43B 7/081 36/38
2011/0131839 A1* 6/2011 Ballin ..... A43B 13/186 36/141
2012/0073161 A1* 3/2012 Doyle ..... A43B 13/203 36/29
2013/0326912 A1* 12/2013 Lindsay ..... A43B 3/0005 36/103
2014/0059887 A1 3/2014 Lawlor
2015/0305436 A1* 10/2015 Doyle ..... A43B 13/203 36/43
2016/0256349 A1* 9/2016 Mayer ..... A43B 3/0005
2017/0099906 A1 4/2017 Figueroa
2017/0340055 A1 11/2017 Schneider
2017/0340056 A1 11/2017 Bunnell et al.

* cited by examiner

SOLE STRUCTURE WITH PISTON AND ADAPTIVE CUSHIONING SYSTEM

CROSS-REFERENCE TO RELATED APPLICATION

This application claims the benefit of priority to U.S. Provisional Application No. 62/424,891, filed Nov. 21, 2016, which is hereby incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole structures in athletic footwear are typically configured to provide cushioning, motion control, and/or resiliency.

DESCRIPTION

Figure 2:
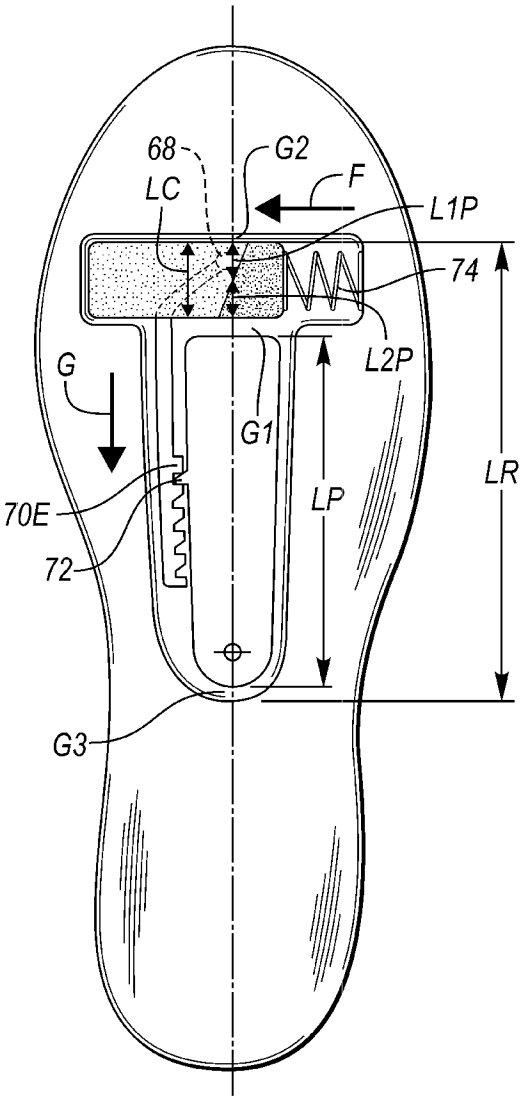
FIG. 2 is a schematic illustration in plan view of the sole structure of FIG. 1 with the cushioning system moved to a final position.

A sole structure for an article of footwear comprises a sole plate that has a foot-facing surface, and a piston disposed on the sole plate at the foot-facing surface. The sole structure further comprises a cushioning system that has a variable cushioning characteristic and is also disposed on the sole plate. The piston deforms the cushioning system, such as by compression, and changes the variable cushioning characteristic of the cushioning system in response to dorsiflexion of the sole plate. The cushioning system is referred to as an adaptive cushioning system due to its change in cushioning characteristic caused by the dorsiflexion. Furthermore, the change in cushioning characteristic may be progressive with repetitive dorsiflexion. The dorsiflexion, and hence the change in cushioning characteristic is human-powered.

Because the variable cushioning characteristic varies in response to (i.e., as a result of) dorsiflexion, the change in the variable cushioning characteristic can be tuned to provide a desired effect on the sole structure that may be correlated with the race, or with the track or course on which the race is run, such as an increase in stiffness as the race progresses, an increase in stiffness in a lateral direction as the race progresses around a curve, or otherwise. In some embodiments, dorsiflexion causes the cushioning system to move relative to the piston. The relative movement of the cushioning system and the change in cushioning characteristic can be tuned for a specific number of steps (i.e., number of dorsiflexions) that a particular athlete is expected to take in a given athletic event, and at different portions of the event.

In various embodiments disclosed herein, the cushioning system may include at least one of a dual-density foam, a polymeric bladder element enclosing a fluid-filled interior cavity, or a smart material, such as a smart material fluid.

The sole plate has a recess at the foot-facing surface, and the piston and the cushioning system are disposed in the recess. As such, the piston and cushioning system are closer to the bend axis of the sole structure, and may be subjected to compressive forces of the sole plate upon sufficient dorsiflexion as discussed herein.

The piston and the sole plate may interface in various ways in the different embodiments. In some embodiments, the piston is fixed to the sole plate at an anchor location, and an unanchored end of the piston between the anchor location and the cushioning system reciprocates toward and away from the cushioning system in response to repeated dorsiflexion of the sole plate. In other embodiments, neither end of the piston is anchored to the sole plate. For example, in some embodiments, the sole plate has a guide track, and the piston engages with the guide track and ratchets incrementally along the guide track in response to repeated dorsiflexion of the sole plate. Whether or not the piston has an anchored end, in some embodiments, an unanchored end of the piston moves toward the cushioning system from a distal position to a proximate position in response to dorsiflexion of the sole plate, and at least one of the sole plate or the cushioning system locks the piston with the unanchored end in the proximate position.

In some embodiments, the sole structure includes a rack that is used to move the cushioning component relative to the piston. Movement of the rack is caused by the dorsiflexion of the sole structure. The rack is secured to the cushioning system. The piston engages with and incrementally ratchets along the rack in response to repeated dorsiflexion of the sole plate. The cushioning system is moved relative to the piston via the piston ratcheting along the rack. For example, in some embodiments, the rack includes a series of teeth, and the piston includes a protrusion that engages each tooth of the series of teeth in succession as the piston incrementally ratchets along the rack.

In some embodiments, the variable cushioning characteristic is a hardness of the cushioning system. For example, the cushioning system may include a dual-density foam cushioning component that has a first portion with a first hardness and a second portion with a second hardness different than the first hardness. Because the piston compresses against the cushioning system at least partially in the forward direction, the hardness of the cushioning system is dependent on the length of the first portion along the longitudinal midline of the sole plate forward of the piston and the length of the second portion along the longitudinal midline of the sole plate forward of the piston. The length of the first portion along the longitudinal midline of the sole plate forward of the piston and the length of the second portion along the longitudinal midline of the sole plate forward of the piston vary according to a position of the cushioning system relative to the piston.

In an embodiment, the rack and the cushioning system are configured so that the cushioning system moves transversely relative to the piston in response to dorsiflexion of the sole plate. For example, the first portion may increase in length in a forward longitudinal direction from a lateral side of the cushioning component to a medial side of the cushioning component, and the second portion may decrease in length in the forward longitudinal direction from the lateral side of the cushioning component to the medial side of the cushioning component. With this configuration, the length of the first portion along the longitudinal midline of the sole plate forward of the piston and the length of the second portion along the longitudinal midline of the sole plate forward of the piston will vary with transverse movement of the cushioning system.

In another embodiment, the rack and the cushioning system are configured so that the cushioning system rotates relative to the piston in response to dorsiflexion of the sole plate, and the position of the cushioning system according to which the length of the first portion along the longitudinal midline of the sole plate forward of the piston and the length of the second portion along the longitudinal midline of the sole plate forward of the piston vary is a rotational position of the cushioning system.

In various embodiments, the sole structure includes a magnet that is secured to the piston and moves with the piston relative to the cushioning system in response to dorsiflexion of the sole plate. The cushioning system includes a smart material fluid, such as a magnetorheological fluid. The smart material fluid is activated by the magnet moving with the piston, and the variable cushioning characteristic is a viscosity of the smart material fluid. For example, the smart material fluid may be a magnetorheological fluid activated by a magnetic field produced by the magnet. As the viscosity varies, the resistance to deformation of the cushioning component or movement of the piston within the fluid also varies.

In an embodiment that includes a smart material fluid, such as an electrorheological fluid, the sole structure may further comprise an additional sole component proximate the cushioning system. The additional sole component may include a piezoelectric material that produces a voltage under compression. For example, the weight of the wearer on the forefoot portion during dorsiflexion may compress the additional sole component sufficiently such that the piezoelectric material produces the voltage that activates the smart material fluid. The voltage can be stored in a capacitor and released by movement of a switch to activate the smart material fluid.

In an embodiment, a sole structure for an article of footwear comprises a sole plate having a foot-facing surface, and a recess in the foot-facing surface. A piston is disposed in the recess, and a cushioning system is disposed in the recess forward of the piston. A rack is secured to the cushioning system. The piston reciprocates toward and away from the cushioning system in response to repeated dorsiflexion of the sole plate. The piston is engaged with and moves the rack as the piston moves away from the cushioning system. The cushioning system moves relative to the piston with the rack, and a hardness of the cushioning system is dependent on a position of the cushioning system relative to the piston.

In an embodiment, the cushioning system includes a dual-density foam cushioning component that has a first portion with a first hardness and a second portion with a second hardness. The length of the first portion along the longitudinal midline of the sole plate forward of the piston and the length of the second portion along the longitudinal midline of the sole plate forward of the piston vary as the cushioning system moves relative to the piston. The hardness of the cushioning system is dependent on the length of the first portion along the longitudinal midline of the sole plate forward of the piston and the length of the second portion along the longitudinal midline of the sole plate forward of the piston.

In an embodiment, a sole structure for an article of footwear comprises a sole plate having a foot-facing surface, and a recess in the foot-facing surface. A piston is disposed in the recess. A cushioning system is disposed in the recess forward of the piston. A magnet is secured to the piston. The cushioning system includes a housing and a smart material fluid contained in the housing. The piston and the magnet move relative to the cushioning system in response to dorsiflexion of the sole plate. The smart material fluid is activated by the magnet moving relative to the cushioning system, varying a viscosity of the smart material fluid.

In an embodiment, the sole structure includes an additional sole component proximate the cushioning system. The additional sole component comprises a piezoelectric material that produces a voltage under compression. The voltage activates the smart material fluid thereby increasing a viscosity of the smart material fluid. The piston deforms the cushioning system when the piston moves toward the housing, and the increased viscosity of the smart material fluid necessitates greater torque than when the smart material fluid is not activated to deform the cushioning system sufficiently so that the sole structure flexes to a predetermined flex angle. In an embodiment, the cushioning system includes a capacitor operative to store the voltage, and a switch selectively movable to release the voltage stored in the capacitor so that the voltage activates the smart material fluid. In an embodiment, the cushioning system locks the piston in a forward-most position when the smart material fluid is activated.

The above features and advantages and other features and advantages of the present teachings are readily apparent from the following detailed description of the modes for carrying out the present teachings when taken in connection with the accompanying drawings.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., may be used descriptively relative to the figures, without representing limitations on the scope of the invention, as defined by the claims.

Figure 1:
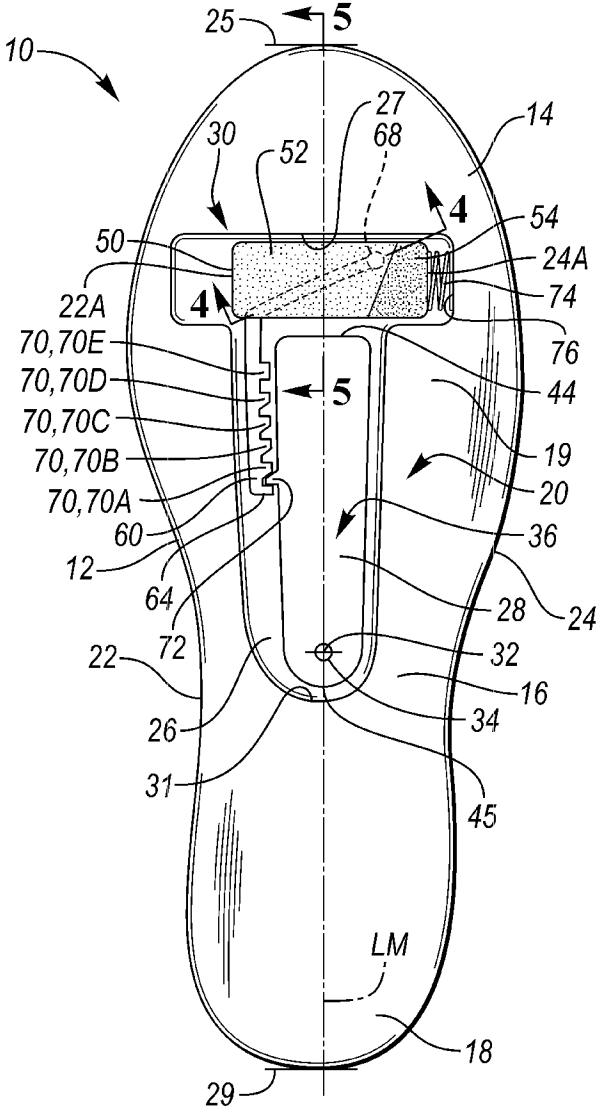
FIG. 1 is a schematic illustration in plan view of an embodiment of a sole structure for an article of footwear with a piston and a cushioning system in an initial position.
Figure 5:
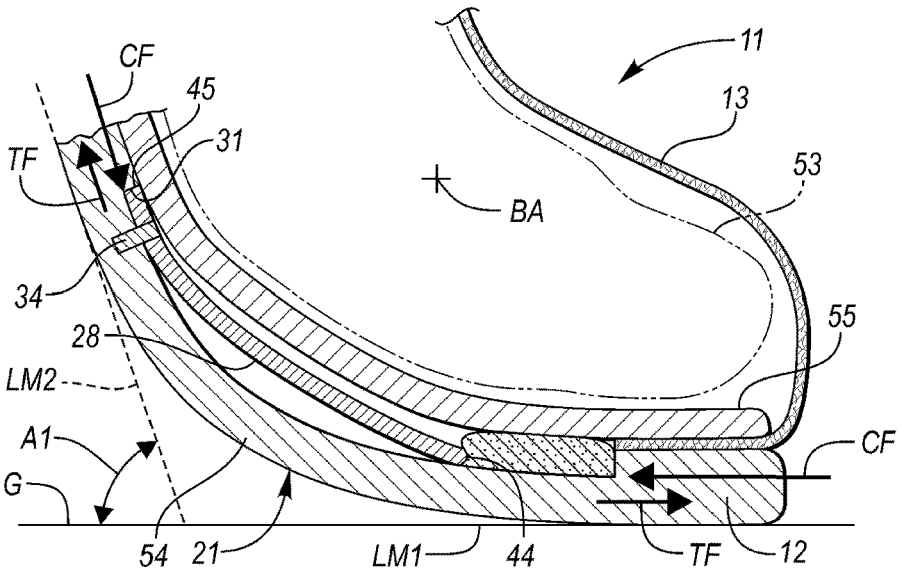
FIG. 5 is a schematic illustration in cross-sectional fragmentary side view of the sole structure of FIG. 1 during dorsiflexion taken at lines 5-5 in FIG. 1.
Figure 9:
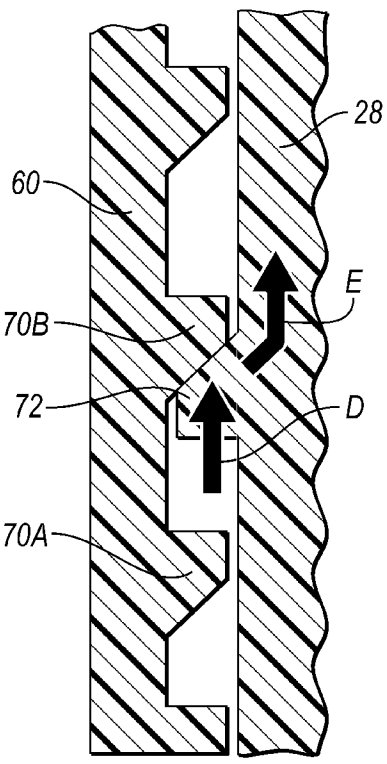
FIG. 9 is a schematic illustration in cross-sectional fragmentary view of the engagement feature of the piston of FIG. 6 sliding up a subsequent tooth of the rack during a subsequent dorsiflexion of the sole structure.

Referring to the drawings, wherein like reference numbers refer to like components throughout the views, FIG. 1 shows a sole structure 10 for an article of footwear 11 indicated in FIG. 5. The sole structure 10 has a resistance to flexion that varies in response to repeated dorsiflexion of the forefoot region 14 of the sole structure 10 (i.e., flexing of the forefoot region 14 in a longitudinal direction as discussed herein). As further explained herein, due to a piston 28 and a cushioning system 30 disposed on a sole plate 12 with the piston 28 configured to move relative to the cushioning system 30 during dorsiflexion of the sole structure 10, a cushioning characteristic of the cushioning system 30 changes. For example, the change in cushioning characteristic may provide a varying stiffness of the cushioning system 30 in reacting forces of the piston 28 acting against the cushioning system 30. The change in cushioning characteristic is tuned by the selection of various structural parameters discussed herein.

Figure 3:
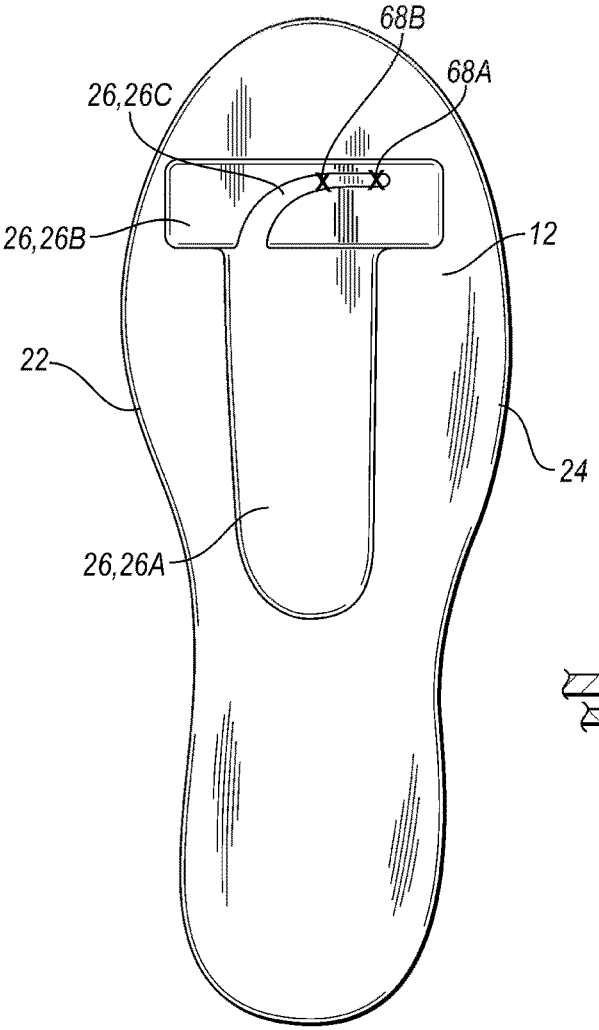
FIG. 3 is a schematic illustration in plan view of a sole plate of the sole structure of FIG. 1.

Referring to FIGS. 1-3, the sole structure 10 includes the sole plate 12 and a piston 28, and may include one or more additional plates, layers, or components, as discussed herein. The article of footwear 11 includes both the sole structure 10 and an upper 13 (shown in FIG. 5). The sole plate 12 is configured to be operatively connected to the upper 13 as discussed herein. The upper 13 may incorporate a plurality of material elements (e.g., textiles, foam, leather, and synthetic leather) that are stitched or adhesively bonded or together or otherwise secured to one another to form an interior void for securely and comfortably receiving a foot 53 as shown. In addition, the upper 13 may include a lace or other tightening mechanism that is utilized to modify the dimensions of the interior void, thereby securing the foot 53 within the interior void and facilitating entry and removal of the foot 53 from the interior void. Accordingly, the structure of the upper 13 may vary significantly within the scope of the present teachings.

The sole structure 10 is secured to the upper 13 and has a configuration that extends between the upper 13 and the ground G (indicated in FIG. 5B). The sole plate 12 may or may not be directly secured to the upper 13. Sole structure 10 may attenuate ground reaction forces (i.e., provide cushioning for the foot 53), and may provide traction, impart stability, and limit various foot motions.

In the embodiment shown, the sole plate 12 is a full-length, unitary sole plate 12 that has a forefoot region 14, a midfoot region 16, and a heel region 18. In other embodiments, the sole plate 12 may be a partial length plate member. For example, in some cases, the sole plate 12 may include only a forefoot region 14 and may be operatively connected to other components of the article of footwear 11 that comprise a midfoot region and a heel region. The sole plate 12 provides a foot support portion 19 that includes a foot-facing surface 20 (also referred to as a foot-receiving surface).

The foot-facing surface 20 extends over the forefoot region 14, the midfoot region 16, and the heel region 18. The foot support portion 19 supports the foot 53 but is not necessarily directly in contact with the foot 53. For example, an insole, midsole, strobel, or other layers or components may be positioned between the foot 53 and the foot-facing surface 20, such as insole 55 in FIG. 5.

The sole plate 12 has a medial side 22 and a lateral side 24. As shown, the sole plate 12 extends from the medial side 22 to the lateral side 24. As used herein, a lateral side of a component for an article of footwear, including the lateral side 24 of the sole plate 12, is a side that corresponds with an outside area of the human foot 53 (i.e., the side closer to the fifth toe of the wearer). The fifth toe is commonly referred to as the little toe. A medial side of a component for an article of footwear, including the medial side 22 of the sole plate 12, is the side that corresponds with an inside area of the human foot 53 (i.e., the side closer to the hallux of the foot of the wearer). The hallux is commonly referred to as the big toe. Both the medial side 22 and the lateral side 24 extend along a periphery of the sole plate 12 from a foremost extent 25 to a rearmost extent 29 of the sole plate 12.

The term "longitudinal", as used herein, refers to a direction extending along a length of the sole structure 10, e.g., extending from the forefoot region 14 to the heel region 18 of the sole structure 10. The term "transverse", as used herein, refers to a direction extending along the width of the sole structure 10, e.g., extending from the medial side to the lateral side of the sole structure 10. The term "forward" is used to refer to the general direction from the heel region 18 toward the forefoot region 14, and the term "rearward" is used to refer to the opposite direction, i.e., the direction from the forefoot region 14 toward the heel region 18. The terms "anterior" and "fore" are used to refer to a front or forward component or portion of a component. The term "posterior" and "aft" are used to refer to a rear or rearward component or portion of a component.

The heel region 18 generally includes portions of the sole plate 12 corresponding with rear portions of a human foot 53, including the calcaneus bone, when the human foot is supported on the sole structure 10 and is a size corresponding with the sole structure 10. The forefoot region 14 generally includes portions of the sole plate 12 corresponding with the toes and the joints connecting the metatarsal bones with the phalange bones of the human foot (interchangeably referred to herein as the "metatarsal-phalangeal joints" or "MPJ" joints). The midfoot region 16 generally includes portions of the sole plate 12 corresponding with an arch area of the human foot, including the navicular joint. Regions 14, 16, 18 are not intended to demarcate precise areas of the sole structure 10. Rather, regions 14, 16, 18 are intended to represent general areas relative to one another, to aid in the following discussion. In addition to the sole structure 10, the relative positions of the regions 14, 16, 18, and medial and lateral sides 22, 24 may also be applied to the upper 13, the article of footwear 11, and individual components thereof.

The sole plate 12 is referred to as a plate, and is generally but not necessarily flat. The sole plate 12 need not be a single component but instead can be multiple interconnected components. For example, both an upward-facing portion of the foot-facing surface 20 and the opposite ground-facing surface 21 (indicated in FIG. 5) may be pre-formed with some amount of curvature and variations in thickness when molded or otherwise formed in order to provide a shaped footbed and/or increased thickness for reinforcement in desired areas. For example, the sole plate 12 could have a curved or contoured geometry that may be similar to the lower contours of the foot 53. The sole plate 12 may have a contoured periphery (i.e., along the medial side 22 and the lateral side 24) that slopes upward toward any overlaying layers, such as a midsole or the upper 13.

The sole plate 12 may be entirely of a single, uniform material, or may have different portions comprising different materials. For example, a first material of the forefoot region 14 can be selected to achieve, in conjunction with the piston 28 and other features and components of the sole structure 10 discussed herein, the desired bending stiffness in the forefoot region 14, while a second material of the midfoot region 16 and/or the heel region 18 can be a different material that has little effect on the bending stiffness of the forefoot region 14. By way of non-limiting example, the second portion can be over-molded onto or co-injection molded with the first portion. Example materials for the sole plate 12 include durable, wear resistant materials. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05 (2010) standard test method) or an Asker C hardness of 65-85 (using hardness test JIS K6767 (1976))) may be used for the sole plate 12.

In the embodiment shown, the sole plate 12 may be an inner board plate, also referred to as an inner board, an insole board, or a lasting board. The sole plate 12 may instead be an outsole. Still further, the sole plate 12 could be a midsole plate or a unisole plate, or may be any combination of an inner board plate, a midsole plate, or an outsole. For example, traction elements may be integrally formed as part of the sole plate 12 (e.g., if the sole plate is an outsole or a unisole plate), may be attached to the sole plate 12, or may be formed with or attached to another plate underlying the sole plate 12, such as if the sole plate 12 is an inner board plate and the sole structure 10 includes an underlying outsole. For example, the traction elements may be integrally formed cleats. In other embodiments, the traction elements may be, for example, removable spikes. The traction elements may protrude below the ground-facing surface 21 of the sole plate 12. In other embodiments, however, the sole structure 10 may have no traction elements, the ground-facing surface 21 may be the ground-contact surface, or other plates or components may underlie the sole plate 12.

The sole plate 12 has a recess 26 at the foot-facing surface 20 that extends only partway through the thickness of the sole plate 12, i.e., only partway from the foot-facing surface 20 to the ground-facing surface 21. The sole plate 12 thus has a reduced thickness at the recess 26. The recess 26 has a forward wall 27 and a rear wall 31. Although the recess 26 is shown as extending generally in the center of the sole plate 12, the recess 26 may extend entirely from the medial side 22 to the lateral side 24 to reduce thickness of the sole plate 12 across the entire width of the sole plate 12 and minimize bending stiffness in a first flexion range.

The piston 28 and the cushioning system 30 are disposed in the recess 26. The piston 28 is fixed to the sole plate 12 at an anchor location 32 that is generally nearer a rear end 45 of the piston 28 than a forward end 44 in the embodiment shown. The anchor location 32 can be at a pin, post, or weld spot that secures the piston 28 to the sole plate 12 such that the piston 28 cannot move relative to the sole plate 12 at the anchor location. In the embodiment shown, a pin 34 extends through the piston 28 and partially through the sole plate 12 to secure the piston 28 to the sole plate 12 at the anchor location 32.

In the embodiment of FIG. 1, the cushioning system 30 includes a dual-density foam cushioning component 50 that moves transversely with respect to the piston 28 with dorsiflexion of the sole structure 10 as discussed herein. The dual-density foam cushioning component 50 has a first portion 52 with a first hardness and a second portion 54 with a second hardness harder than the first hardness. As used herein, "hardness" refers to hardness in compression, such as on a Shore C hardness scale. Alternatively, the cushioning component 50 could be a polymeric bladder element that encloses a fluid-filled interior cavity, in which case the first portion 52 could be a first portion of the interior cavity, and the second portion 54 could be a second portion of the interior cavity. Fluid pressure in the first portion 52 of the cavity could be less than fluid pressure in the second portion 54 of the cavity so that the second portion 54 is harder than the first portion 52.

The piston 28 is shown in FIG. 1. The foot-facing surface 36 of the piston 28 rests generally level with the foot-facing surface 20 of the foot support portion 19 when the piston 28 is secured to the sole plate 12 in the recess 26 as described and the sole structure 10 is in an unflexed, generally relaxed state as shown in FIG. 1. The forward end 44 of the piston 28 is not fixed to the sole plate 12 and oscillates back and forth into and out of contact with the cushioning system 30 with repetitive dorsiflexion of the sole structure 10. The forward end 44 is an unanchored end of the piston 28 positioned between the anchor location 32 and the cushioning system 30, and it reciprocates toward and away from the cushioning system 30 in response to repeated dorsiflexion of the sole plate 12. More specifically, the forward end 44 of the piston 28 reciprocates from the distal position shown in FIG. 1 (with gap G1 between the forward end 44 and the cushioning component 50) to a proximate position in contact with the cushioning component 50, at which the forward end 44 may be anywhere from the rear end of the cushioning component 50 at the gap G1, to extending into the cushioning component 50 with deformation of the cushioning component 50 by compression, such as shown in FIG. 5. When the sole structure 10 is in the relaxed, unflexed state of FIG. 1, a gap G1 exists between the piston 28 and the cushioning component 50 such that the forward end 44 of the piston 28 is not in contact with the cushioning component 50. With reference to FIG. 2, the sum of the length LP of the piston 28 from the rear end 45 to the forward end 44 plus the length LC of the cushioning component 50 along the longitudinal midline LM is less than the length from the rear wall 31 to the forward wall 27 of the recess 26.

Figure 4:
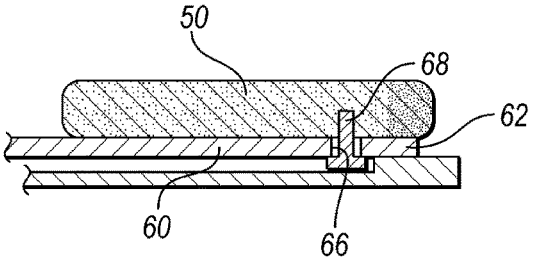
FIG. 4 is a schematic illustration in fragmentary cross-sectional view of the sole structure of FIG. 1 taken at lines 4-4 in FIG. 1.

A rack 60 is secured to the cushioning system 30. The rack 60 is a generally elongated flexible strap that is secured at one end 62 to the cushioning component 50 as best shown in FIG. 4. The rack 60 has an opening 66 and a pin 68 extends through the opening 66 into the cushioning component so that the rack 60 is secured to the cushioning component 50 by the pin 68. The rack 60 has a free end 64 (shown in FIG. 1) that is not secured to the sole plate 12. The rack 60 has a series of gear teeth 70 near the free end 64. The piston 28 includes a protrusion 72 that extends toward the teeth 70 and incrementally engages each tooth 70 of the series of teeth in succession with repetitive dorsiflexion. In the embodiment shown, the protrusion 72 is a tooth 72. The piston 28 engages with and incrementally ratchets along the rack in response to repeated dorsiflexion of the sole plate 12 via the tooth 72, causing the cushioning system 30 to move transversely relative to the piston 28 and the sole plate 12.

The rack 60 is secured to the cushioning component 50 with the pin 68 as described. With reference to FIGS. 3 and 4, the recess 26 includes a first portion 26A in which the piston 28 is disposed, a second portion 26B in which the cushioning component 50 is disposed, and a third portion 26C recessed further in the sole plate 12 than the second portion (i.e., below the second portion 26B) and in which the rack 60 travels below the cushioning component 50. The second portion 26B is wider laterally than the first portion 26A in order to allow the transverse movement of the cushioning component 50 as discussed herein. The pin 68 moves in the third portion 26C from the position 68A in FIG. 3 to the position 68B in FIG. 3 corresponding with the pin 68 shown in phantom in FIGS. 1 and 2, respectively. As the rack 60 and cushioning component 50 go from the initial position of FIG. 1 to the final position of FIG. 2.

A tension spring 74 is positioned in the recess 26 and is secured at one end to the sole plate 12 and at an opposite end to the cushioning component 50. The tension spring 74 biases the cushioning component 50 toward a sidewall 76 of the recess 26, and to the starting position shown in FIG. 1. As shown in FIG. 1, the tooth 72 is positioned in a notch of the rack 60 between the end 64 and a first tooth 70A of the teeth 70 when the cushioning component 50 is in the start position of FIG. 1. The gear teeth 70 have a profile angle that inclines toward tips of the teeth 70 in a forward direction. As shown in FIG. 1, the tooth 72 has a profile angle that inclines toward a tip of the tooth 72 in a rearward direction when the piston 28 is in the unflexed, relaxed state of FIG. 1. As discussed with respect to FIGS. 6-9, the tooth 72 engages with each tooth 70 successively, and ratchets the rack 60 as the piston 28 translates fore and aft relative to the sole plate 12 with repetitive dorsiflexion of the sole structure 10. The teeth will likely have a smaller pitch and be greater in number than shown so that a greater number of dorsiflexions will be required to move the cushioning component from the initial position to the final position. Only five teeth are shown in FIG. 1 for clarity in the drawing, however. In other embodiments, both the rack 60 and the piston 28 may have many more teeth of smaller pitch to enable a longer progression of the cushion component 50 to move transversely sideways.

In this and other embodiments described herein in which the progression of the piston forward or movement of the cushioning system relative to the piston is according to progression along teeth or other protrusions, the number of teeth or protrusions can be correlated with a number of steps a person wearing the sole structure is expected to take when utilizing the sole structure for a predetermined event, such as participating in a race of a particular distance and/or on a track or course of a known route. In this manner, the change in cushioning characteristic can aid the wearer by varying the variable cushioning characteristic in a manner advantageous to the wearer, such as by increasing or decreasing longitudinal or transverse bending stiffness in correlation with various stages of the race. The expected number of steps can be specific to a particular athlete, or may represent a population average for the expected population of wearers. The increased stiffness may help to maintain proper form when the foot is fatigued.

Figure 7:
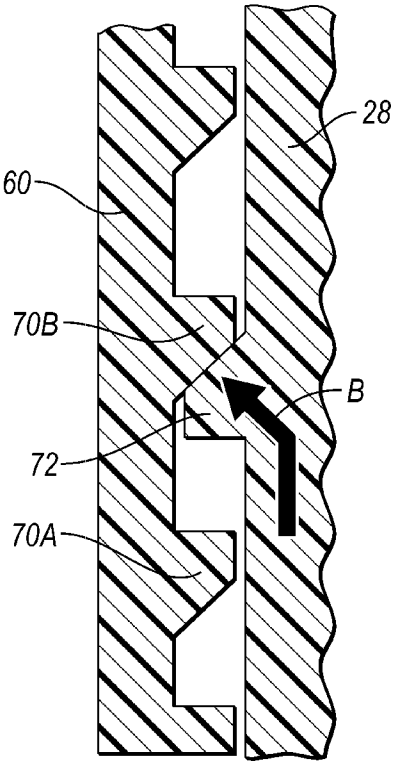
FIG. 7 is a schematic illustration in cross-sectional fragmentary view of the engagement feature of the piston of FIG. 6 after moving over the tooth.
Figure 6:
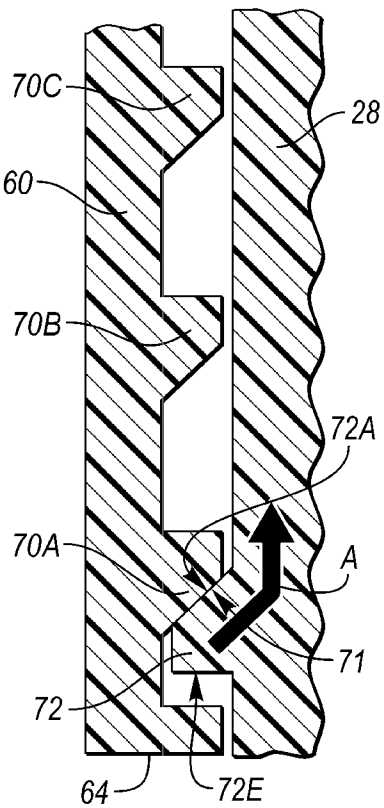
FIG. 6 is a schematic illustration in cross-sectional fragmentary view of an engagement feature of the piston of FIG. 1 sliding up a tooth of a rack of the cushioning system of FIG. 1 during dorsiflexion of the sole structure.
Figure 11:
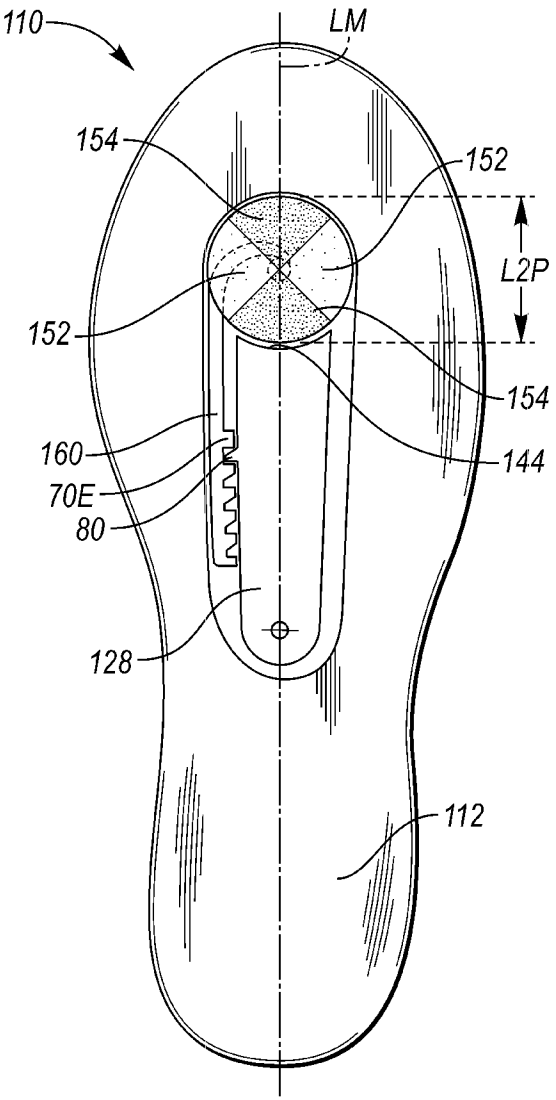
FIG. 11 is a schematic illustration in plan view of the sole structure of FIG. 10 with the cushioning system in a final position.
Figure 10:
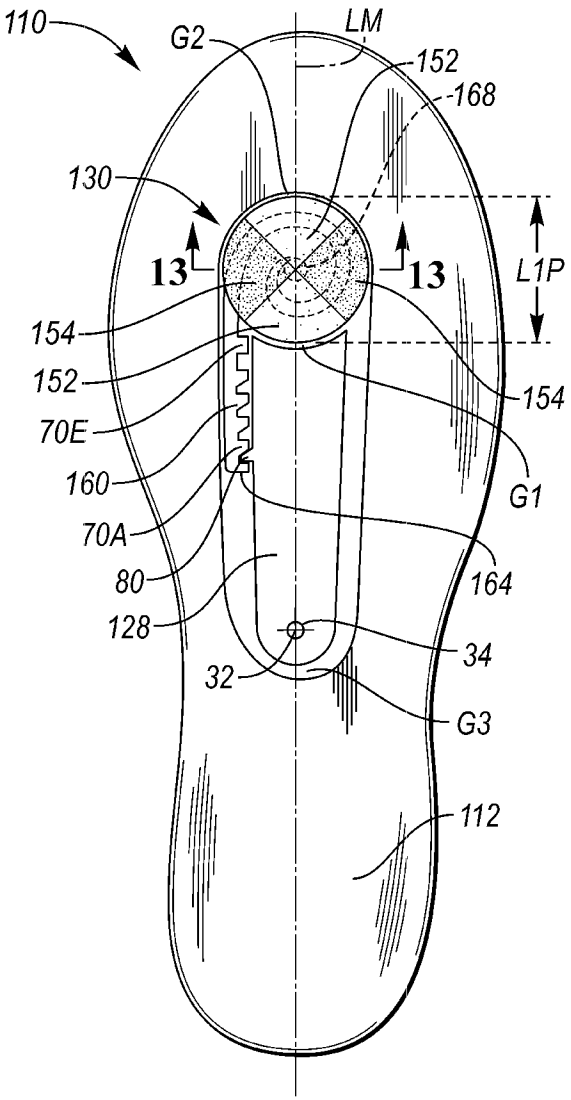
FIG. 10 is a schematic illustration in plan view of an alternative embodiment of a sole structure for an article of footwear with a piston and a cushioning system in an initial position.

FIG. 5 represents the position of the forward end 44 of the piston 28 when the sole structure 10 is flexed at a flex angle A1 during an initial dorsiflexion with the forefoot region 14 of the sole structure 10 operatively engaged with the ground G. A flex angle A1 is defined as the angle formed at the intersection between a first axis LM1 and a second axis LM2. The first axis LM1 generally extends along the longitudinal midline LM of the sole plate 12 at the ground-facing surface 21 of the sole plate 12 at a forward part of the sole plate 12. The second axis LM2 generally extends along the longitudinal axis LM of the sole plate 12 at the ground-facing surface 21 of the sole plate 12 at a rearward part of the recess 26. The sole plate 12 is configured so that the intersection of the first axis LM1 and the second axis LM2 is approximately centered both longitudinally and transversely below the metatarsal-phalangeal joints of the foot 53 supported on the foot-facing surface 20 of the sole plate 12. The sole plate 12 and the piston 28 will be flexed as in FIG. 6 so that the mating gear tooth faces 72A, 71 of teeth 72, 70A, respectively, will be in contact, and the forward weight of the foot 53 (represented by arrow A) will urge the piston 28 to move forward relative to the sole plate 12. FIGS. 6 and 7 show the resulting progression of the tooth 72 up (arrow A) and over (arrow B) the tooth 70A of the rack 60.

Figure 8:
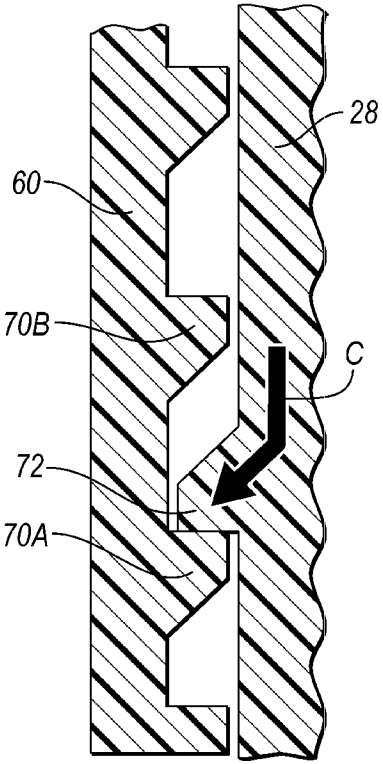
FIG. 8 is a schematic illustration in cross-sectional fragmentary view of the engagement feature of the piston of FIG. 6 sliding back toward the tooth following dorsiflexion.

Following the initial dorsiflexion, as the foot 53 plantar flexes and lifts the forefoot region 14 of the article of footwear 11 out of operative engagement with the ground G, and then the article of footwear 11 comes into contact with the ground G at a point rearward of the forefoot region 14, such as at the heel region 18 or at a more rearward part of the forefoot region 14 during a sprint, the foot 53 no longer urges the piston 28 forward relative to the sole plate 12. The piston 28 moves rearward relative to the sole plate 12, returning to its relatively relaxed state of FIG. 1, as indicated by arrow C in FIG. 8 showing relative movement of the piston 28 rearward. The faces of the gear teeth 70 opposite to their inclined faces are substantially parallel to the rear face 72E of the tooth 72, and prevent further movement of the piston 28 rearward relative to the sole plate 12, and further movement of the sole plate 12 forward relative to the piston 28. In a subsequent dorsiflexion with the forefoot region 14 in operative engagement with the ground G, the process repeats, and the tooth 72 progresses up and over the next forward tooth 70B, as indicted by arrows D and E in FIG. 9. In this manner, the tooth 72 continues to ratchet along the rack 60, pulling the rack 60 rearward relative to the piston 28 tooth-by-tooth in response to repeated dorsiflexion of the sole structure 10 until the tooth 72 progresses over the forward-most tooth 70D of the series of teeth 70, shown in FIG. 2. A blocking tooth 70E shown in FIG. 1 does not have an inclined face, and prevents further ratcheting of the rack 60. The rack 60 then remains in the position of FIG. 2 during any further dorsiflexion. Arrow F shows the direction of movement of the cushioning component 50 with successive dorsiflexion. Arrow G shows the direction of movement of the rack 60 with successive dorsiflexion.

As the cushioning component 50 moves from the initial position of FIG. 1 to the final position of FIG. 2 over a series of progressive dorsiflexions of the sole structure 10, the cushioning component 50 moves transversely relative to the sole plate 12 due to the ratcheting of the tooth 72 along the rack 60 as described. The length L1P of the first portion 52 along a longitudinal midline LM of the sole plate 12 forward of the piston 28 and the length L2P of the second portion 54 along the longitudinal midline LM of the sole plate 12 forward of the piston 28 vary according to a position of the cushioning component 50 relative to the piston 28. For example, in FIG. 1, only the first portion 52 falls along the longitudinal midline LM forward of the piston 28 when the cushioning component 50 is in the initial position of FIG. 1. The length of the second portion 54 along the longitudinal midline LM forward of the piston 28 is zero. About one-half of the first portion 52 and about one-half of the second portion 54 lie along the longitudinal midline LM forward of the piston 28 when the cushioning component 50 has moved to the final position of FIG. 2. The length of the first portion 52 forward of the piston 28 and the length of the second portion 54 forward of the piston 28 vary across the width of the piston 28, but because the piston 28 is generally centered along the longitudinal midline LM, the lengths of the first portion 52 and of the second portion 54 along the longitudinal midline LM of the sole plate 12 are used as representative lengths.

The hardness of the cushioning system 30 is dependent on the length of the first portion 52 along the longitudinal midline LM of the sole plate forward of the piston 28 and the length of the second portion 54 along the longitudinal midline LM of the sole plate 12 forward of the piston 28. Stated differently, the cushioning system 30 has a cushioning characteristic (which in this embodiment is hardness) that varies with the position of the cushioning component 50 relative to the piston 28. The variable cushioning characteristic progressively varies with dorsiflexion of the sole structure 10. The cushioning system 30 can be referred to as an adaptive system as the variable cushioning characteristic progressively changes. In the embodiment shown, the hardness progressively increases, resulting in increasing stiffness with dorsiflexion. In the embodiment of FIG. 1, this is accomplished by configuring the dual-density foam cushioning component 50 so that the first portion 52 increases in length in a forward longitudinal direction from a lateral side 24A of the cushioning component to a medial side 22A of the cushioning component 50, and the second portion 54 decreases in length in the forward longitudinal direction from the lateral side 24A of the cushioning component 50 to the medial side 22A of the cushioning component 50. As the cushioning component 50 moves transversely from the initial position of FIG. 1 to the second, final position of FIG. 2, more of the relatively hard foam of the second portion 54 is exposed forward of the piston 28 and effects the operative engagement of the piston 28. The lengths of the first and second portions 52, 54 along the longitudinal midline LM forward of the piston 28 could be varied by configuring the portions 52, 54 with different shapes, and the embodiment shown is only one example. Still further, in an alternative embodiment, the second portion 54 could be softer than the first portion 52, so that the hardness decreases with progressive dorsiflexion (i.e., as the cushioning component 50 moves from the initial to the final position). Moreover, more than two portions could be used, so that the hardness could increase during initial transverse movement, and then decrease.

The variable cushioning characteristic of the cushioning component 50 along the longitudinal midline LM affects the flex angle at which operative engagement of the piston 28 with the sole plate 12 will occur, thereby influencing a change in bending stiffness. Moving the cushioning component 50 transversely changes the bending stiffness that the sole plate 12 exhibits at similar flex angles. In other words, the sole plate 12 may exhibit a first bending stiffness at a first predetermined flex angle A1 with the cushioning component in the position shown in FIG. 1, and exhibit a second bending stiffness at the same first predetermined flex angle A1 with cushioning component 50 moved transversely relative to the piston 28, such as in the position of FIG. 2.

As will be understood by those skilled in the art, during bending of the sole structure 10 as the foot 53 is dorsiflexed, there is a layer in the sole plate 12 referred to as a neutral plane (although not necessarily planar) or a neutral axis above which the sole plate 12 is in compression, and below which the sole plate 12 is in tension. It should be appreciated that the neutral axis is not the bend axis about which bending occurs. The bend axis BA (indicated in FIG. 5) is positioned above the foot-facing surface 20, and represents the axis about which the foot 53 bends. Torque on the sole structure 10 results from a force applied at a distance from the bend axis BA located in the proximity of the metatarsal phalangeal joints, as occurs when a wearer flexes the sole structure 10. The position of the bend axis BA changes as the foot 53 progresses through dorsiflexion. Those skilled in the art will appreciate that portions of the sole plate 12 (such as portions of the sole plate 12 near the foot-facing surface 20) may be placed in compression during dorsiflexion of the sole plate 12, while other portions of the sole plate 12, (such as portion of the sole plate 12 near the ground-facing surface 21) may be placed in tension during dorsiflexion of the sole plate 12. The sole plate 12 has a compressive portion above the neutral axis and a tensile portion below the neutral axis. Generally, the further displaced material is from the neutral bend axis, the greater the torque required to bend the material, and the greater the compressive or tensile forces on the material. The further from the neutral axis that the compressive and tensile forces of the sole plate 12 are applied, the greater the bending stiffness of the sole plate 12.

As the piston 28 ratchets along the series of teeth 70, the bending stiffness of the sole structure 10 varies due to the varying hardness and associated compressibility of the transversely-moving cushioning component 50 against which the piston 28 reacts. The piston 28 can continue moving forward further against a more compressible (i.e., softer) cushioning component than against a less compressible (i.e., harder) cushioning component. Due to the difference in length along the longitudinal midline LM of the piston 28 and the recess 26 as described with respect to FIG. 2, at flex angles less than the first predetermined flex angle A1 of FIG. 5, a gap exists between one or both ends of the piston 28 and the sole plate 12. More specifically, a gap G1 exists between the forward end 44 of the piston 28 and the cushioning component 50, and a gap G2 exists between the cushioning component 50 and the forward wall 27 of the sole plate 12 at the recess 26. An additional gap G3 may exist between the rear wall 31 and the rear end 45 of the piston 28 when the sole structure 10 is in the unflexed position of FIG. 1 and the cushioning component 50 is in the initial position of FIG. 1.

The difference between the length LR along the longitudinal midline LM of the recess 26 and the sum of the lengths LP and LC of the piston 28 and the cushioning component 50 enables the piston 28 to flex free from compressive loading by the sole plate 12 when the sole structure 10 is flexed in a longitudinal direction at flex angles less than the first predetermined flex angle A1. When the piston 28 has compressed the cushioning component 50 to a maximum extent under the applied torque load, the piston 28 is operatively engaged with the sole plate 12. It is assumed for purposes of discussion that the flex angle A1 is that at which operative engagement of the piston 28 with the sole plate 12 first occurs.

Accordingly, as a foot 53 flexes, placing torque on the sole structure 10 and causing the sole structure 10 to flex at the forefoot region 14 by lifting the heel region 18 away from the ground G while maintaining contact with the ground G at a forward portion of the forefoot region 14, the piston 28 will flex, but will do so free from compressive loading by the sole plate 12 over a first range of flex (i.e., flex angles of less than the first predetermined flex angle A1, shown in FIG. 5). The bending stiffness of the sole structure 10 during the first range of flex will be at least partially correlated with the bending stiffness of the sole plate 12 and of the piston 28, but there is no compressive loading of the piston 28 by the sole plate 12. The bending stiffness of the sole plate 12 provides the resistance against dorsiflexion of the sole plate 12 in the longitudinal direction along the longitudinal midline LM of the sole plate 12.

At increasing flex angles, the cushioning component 50 begins to be compressed by the piston 28. Accordingly, stiffness in this range of flexion is at least partially correlated with the hardness of the cushioning component 50. As discussed above, the hardness of the cushioning component 50 varies with the transverse position of the cushioning component 50.

At the predetermined flex angle A1 shown in FIG. 5, the cushioning component 50 has moved to the final position of FIG. 2 and has reached its maximum compression by the piston 28. The piston 28 is operatively engaged with the sole plate 12 as all of the gaps G1, G2 and G3 are closed. When the sole structure 10 is flexed to at least the first predetermined flex angle A1, because the flexing of the sole plate 12 occurs generally in the forefoot region 14 at the recess 26, the length of the recess 26 between the forward wall 27 and the rear wall 31 is shorter than the sum of the lengths LC and LP. In other words, the length of the recess 26 in the longitudinal direction is foreshortened more than the piston 28 as it is further from the center of curvature of the flexed sole structure 10. The cushioning component 50 thus engages the forward wall 27 and the rear end of the piston 28 engages the rear wall 31 due to the slightly foreshortened recess 26. The forward end 44 of the piston 28 is operatively engaged with cushioning component 50, the rear end 45 of the piston 28 is operatively engage with the sole plate 12, and the cushioning component 50 is operatively engaged with the forward wall 27 of the recess 26 and is compressed to a maximum compression under the torque load such that the piston 28 flexes under compression by the sole plate 12 (through the cushioning component 50 at the forward end 44) as indicated by force arrows CF in FIG. 5. As used herein, the piston 28 is "operatively engaged" with the sole plate 12 when compressive force CF of the sole plate 12 is transferred to the piston 28 during flexing in the longitudinal direction. Due to the operative engagement of the piston 28 and the sole plate 12, a second portion 54 of the sole plate 12 below the recess 26 and closer to the ground G (and therefore further from the center of curvature of the flexing) is under additional tension. The tension is indicated by force arrows TF in FIG. 5. The sole structure 10 thereby has a change in bending stiffness at the first predetermined flex angle A1. The operative engagement of the piston 28 with the sole plate 12 places additional tension on the sole plate 12 below the neutral axis, such as at a bottom surface of the sole plate 12, effectively shifting the neutral axis of the sole plate 12 upward (away from the bottom surface). The stiffness of the sole structure 10 at flex angles greater than or equal to the first predetermined flex angle A1 is at least partially correlated with the compressive loading of the piston 28 and with the added tensile forces on the sole plate 12.

FIGS. 10-13 show another embodiment of a sole structure 110 that can be used in place of sole structure 10 in the article of footwear 11. The sole structure 110 has many of the same components as the sole structure 10. These components are referred to with identical reference numbers and function as described with respect to sole structure 10. The sole structure 110 has a sole plate 112 and a cushioning system 130 with a cushioning component 150 and rack 160 instead of cushioning component 50 and rack 60. The rack 160 and the cushioning system 130 are configured so that the cushioning system 130, and more specifically, the cushioning component 150 of the cushioning system 130, rotates relative to the piston 128 in response to repetitive dorsiflexion of the sole plate 112. The lengths of the first portion 152 and the second portion 154 along the longitudinal midline LM forward of the piston 28 vary according to the rotational position of the cushioning system 130.

The cushioning component 150 is substantially circular, and has a first portion 152 and a second portion 154. The first portion 152 and the second portion 154 each have multiple sections arranged opposite one another. The cushioning component 150 may be dual-density foam, with the first portion 152 having a first density and first hardness, and the second portion 154 having a second density and second hardness greater than the first density and first hardness.

In another embodiment, the cushioning component 150 could be a polymeric bladder element that encloses a fluid-filled interior cavity. The first portion 152 could be a first portion of the interior cavity, and the second portion 154 could be a second portion of the interior cavity. Fluid pressure in the first portion 152 of the cavity could be less than fluid pressure in the second portion 154 of the cavity so that the second portion 154 is harder than the first portion 152.

Figure 12:
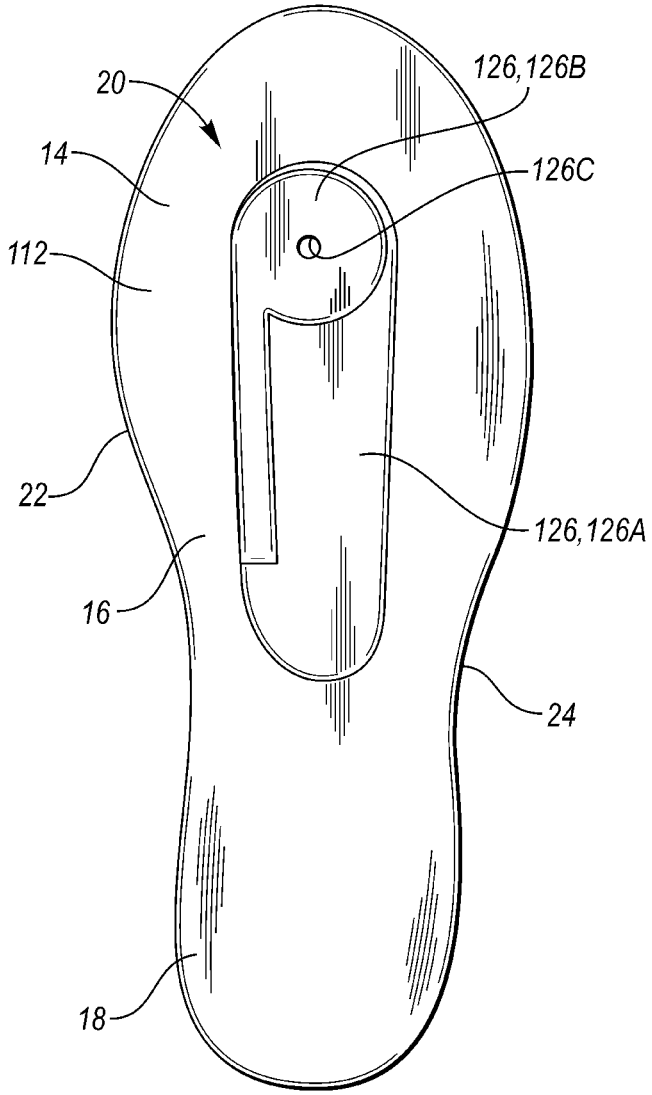
FIG. 12 is a schematic illustration in plan view of a sole plate of the sole structure of FIG. 10.
Figure 13:
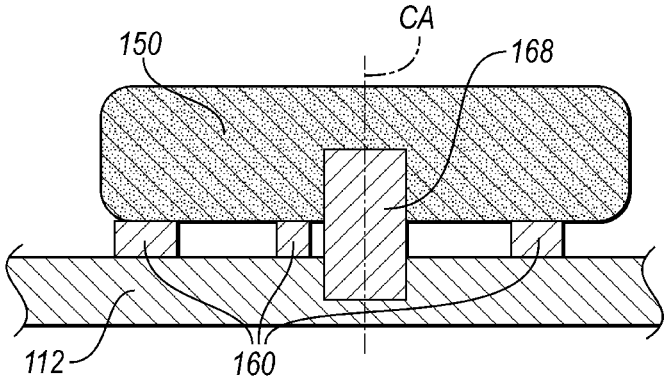
FIG. 13 is a schematic illustration in fragmentary cross-sectional view of the sole structure of FIG. 10 taken at lines 13-13 in FIG. 10.

The rack 160 is alike in all aspects as rack 60, except that it coils around a pin 168 that secures the cushioning component 150 to the sole plate 112. With reference to FIG. 12, the sole plate 112 has a recess 126 with a first portion 126A in which the piston 128 is disposed, and a second portion 126B in which the cushioning component 150 and the rack 160 are disposed. A third portion 126C of the recess 126 is sized to allow the pin 168 to rotate about its center axis CA. The rack 160 is a torsion spring, and is biased to the initial position of FIG. 10. An inner end of the rack 160 is secured to the pin 168. The rack 160 spirals outward around the pin 168 to the free end 164. The forward end 144 of the piston 128 is curved to match the curve of the periphery of the cushioning component 150.

The piston 128 ratchets the rack 160 in response to repeated dorsiflexion of the sole structure 110 in the same manner as described with respect to piston 28 and rack 60 to vary the length of first portion 152 (L1P) and the length of the second portion 154 (L2P) along the longitudinal midline LM forward of the piston 128. In the initial position of FIG. 10, only the first portion 152 has a length along the longitudinal midline LM. The length of the second portion 154 along the longitudinal midline LM forward of the piston 128 is zero. The hardness of the cushioning component 150 under compression by the piston 28 when in the initial position is that of the first portion 152. Ratcheting of the rack 160 causes the cushioning component 150 to rotate about 90 degrees to the final position of FIG. 11. At the final position, the tooth 80 is in the last notch of the rack 60 and is blocked by the blocking tooth 70E. At the final position, only the second portion 154 lies along the longitudinal midline LM forward of the piston 128. The length of the first portion 152 along the longitudinal midline LM forward of the piston 128 is zero. The hardness of the cushioning component 150 under compression by the piston 28 when in the final position is that of the second portion 154. The arrangement of the first portion 152 and the second portion 154 is only one non-limiting example. Other orientations of the first portion 152 and second portion 154 may be used to progressively vary the hardness of the cushioning component 150 as it rotates. For example, the first portion 152 and the second portion 154 could instead be arranged as sections spiraling from the center of the circular cushioning component 150. Still further, the cushioning component 150 may vary in thickness such that the average thickness forward of the piston 128 varies with the rotational position of the cushioning component 150.

The harder the cushioning component 150, the less compressible it is under a given torque, and the piston 128 will thus operatively engage with the sole plate 112 at a smaller flex angle during dorsiflexion than if the cushioning component 150 were softer. Stated differently, the piston 128 can move further forward in the recess before it operatively engages with the sole plate 112 through the compressed cushioning component 150. The stiffness of the sole structure 110 to bend to a predetermined flex angle is thus greater when the cushioning component 50 encountered by the piston 128 is harder. Greater torque (i.e., effort by the wearer) is required to dorsiflex the sole structure 110 to a given flex angle when the cushioning component 150 is harder.

Figure 14:
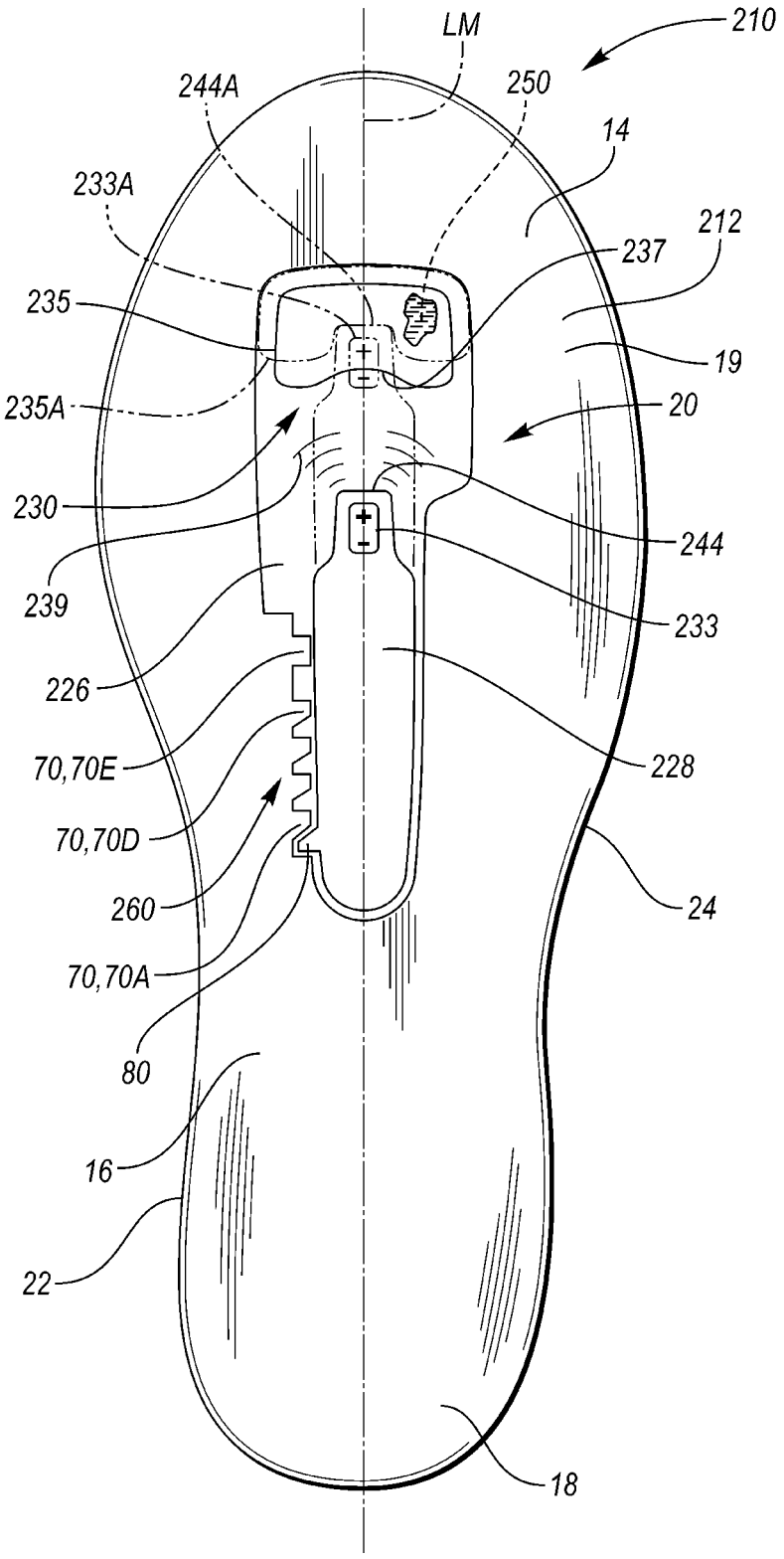
FIG. 14 is a schematic illustration in plan view of an alternative embodiment of a sole structure for an article of footwear with a piston and a cushioning system in an initial position, and showing a final position of the piston in phantom.

FIGS. 14-17 show alternative embodiments of sole structures for an article of footwear that include many of the same features as the sole structure 10 of FIG. 1, but in which the cushioning system includes a smart material fluid. FIG. 14 shows a sole structure 210 that can be used in place of sole structure 10 in the article of footwear 11. The sole structure 210 has many of the same components as the sole structure 10. These components are referred to with identical reference numbers and function as described with respect to sole structure 10.

The sole structure 210 has a sole plate 212 with a recess 226 in the foot-facing surface 20. The sole structure 210 also includes a piston 228 disposed in the recess 226. The piston 228 has a protrusion that is a tooth 80. Neither end of the piston 228 is anchored to the sole plate 212. The sole plate 212 has a guide track 260 with teeth 70 that function in the same manner as teeth 70 of the rack 60 of FIG. 1. The piston 228 is placed in the recess 226 with the tooth 80 rearward of tooth 70A in an initial position of FIG. 14. When the sole structure 210 is dorsiflexed repeatedly, the piston 228 progresses along the teeth 70 until the tooth 80 passes over tooth 70D and is prevented from further forward progression by the blocking tooth 70E. A removable pin (not shown) may extend through the piston 228 and sole plate 212 to temporarily maintain the piston 228 in the initial position until the functionality of the piston 228 and cushioning system 230 is desired. For example, the pin may be removed at the beginning of a race. A similar pin may be used in any of the embodiments described herein.

The cushioning system 230 includes a housing 235 and a smart material fluid 250 contained in the housing 235. The smart material fluid 250 is a magnetorheological fluid in the embodiment shown. The fluid 250 fills the housing 235. Only a portion of the fluid 250 is shown for clarity in the drawings. The housing 235 may be a polymeric material, such as a bladder element, that forms a sealed interior chamber that houses the smart material fluid 250. The sole structure 210 includes a permanent magnet 233 that is secured to the piston 228 near a forward end 244 of the piston 228. The magnet 233 moves with the piston 228 relative to the cushioning system 230 by dorsiflexion of the sole plate 212. Accordingly, as the piston 228 ratchets along the teeth 70, the magnet 233 moves closer to the smart material fluid 250. In another embodiment, the magnet 233 need not be on the forward end of the piston 228. The piston 228 could instead have an arm that extends forward and transversely, and the magnet 233 may be mounted on the arm. In this manner, the magnet moves closer to the smart material fluid 250 along a lateral or medial side of the housing 235.

The housing 235 is generally U-shaped, and may have a central pocket 237. Alternatively, the housing 235 may be an elongated tube arranged with its length extending transversely, similar to housing 335 in FIG. 15. When the piston 228 advances forward along the teeth 70 with repetitive dorsiflexion of the sole structure 210 to the final position in which the tooth 80 is at the blocking tooth 70E, the forward end 244 of the piston 228 and the magnet 233 are in the pocket 237 (as indicated in phantom at 244A and 233A, respectively). The piston 228 is tapered at the end 244 so that the magnet 233 can fit within the pocket 237. The housing 235 and the smart material fluid 250 thus surround the magnet 233 at the front and sides of the magnet 233 when the front of the piston 228 is in the final position in the pocket 237. The housing 235 could also extend over the pocket 237 (i.e., above the pocket 237), so that the smart material fluid 250 also extends above the magnet 233.

The smart material fluid 250 is a magnetorheological fluid. The variable cushioning characteristic of the cushioning system 230 that changes as the piston 228 moves relative to the cushioning system 230 is a viscosity of the smart material fluid 250. As is understood by those skilled in the art, the magnet 233 produces a magnetic field 239. As the magnet 233 moves closer to the smart material fluid 250, the smart material fluid 250 is activated by the magnetic field 239. Activation of the smart material fluid 250 increases its viscosity. The field 239 moves closer to the smart material fluid 250 as the piston 228 moves from the start position to the final position, so that the viscosity of the smart material fluid 250 continually increases.

When the sole structure 210 is dorsiflexed with the piston 228 in the advanced position shown in phantom, the piston 228 will contact and deform the housing 235, compressing it against the sole plate 212 at the forward end of the recess 226 as understood by the phantom lines representing the deformed housing 235A. The housing 235 may also deform outward in the transverse direction and deform against the lateral and medial walls of the sole plate 212 at the recess 226. More effort is required to deform the housing 235 with the magnetorheological fluid 250 therein due to the increased viscosity of the fluid 250. Stated differently, the sole structure 210 increases in stiffness from the initial position to the final position of the piston 228. Greater torque (i.e., effort by the wearer) is required to dorsiflex the sole structure 210 to a given flex angle when the magnet 233 is closer to the smart material fluid 250. Accordingly, bending stiffness of the sole structure 210 increases with repetitive dorsiflexion as the magnet 233 moves with the piston 228.

In another embodiment, the magnet 233 need not be on the forward end of the piston 228 that contacts the housing 235 as shown. Instead, the piston 228 may have an extension arm that extends forward and laterally relative to the end 444. The magnet 233 may be mounted on the extension arm so that it is moves generally alongside of the housing 235 at the medial or lateral side of the housing to affect the viscosity of the smart material fluid 250.

Figure 15:
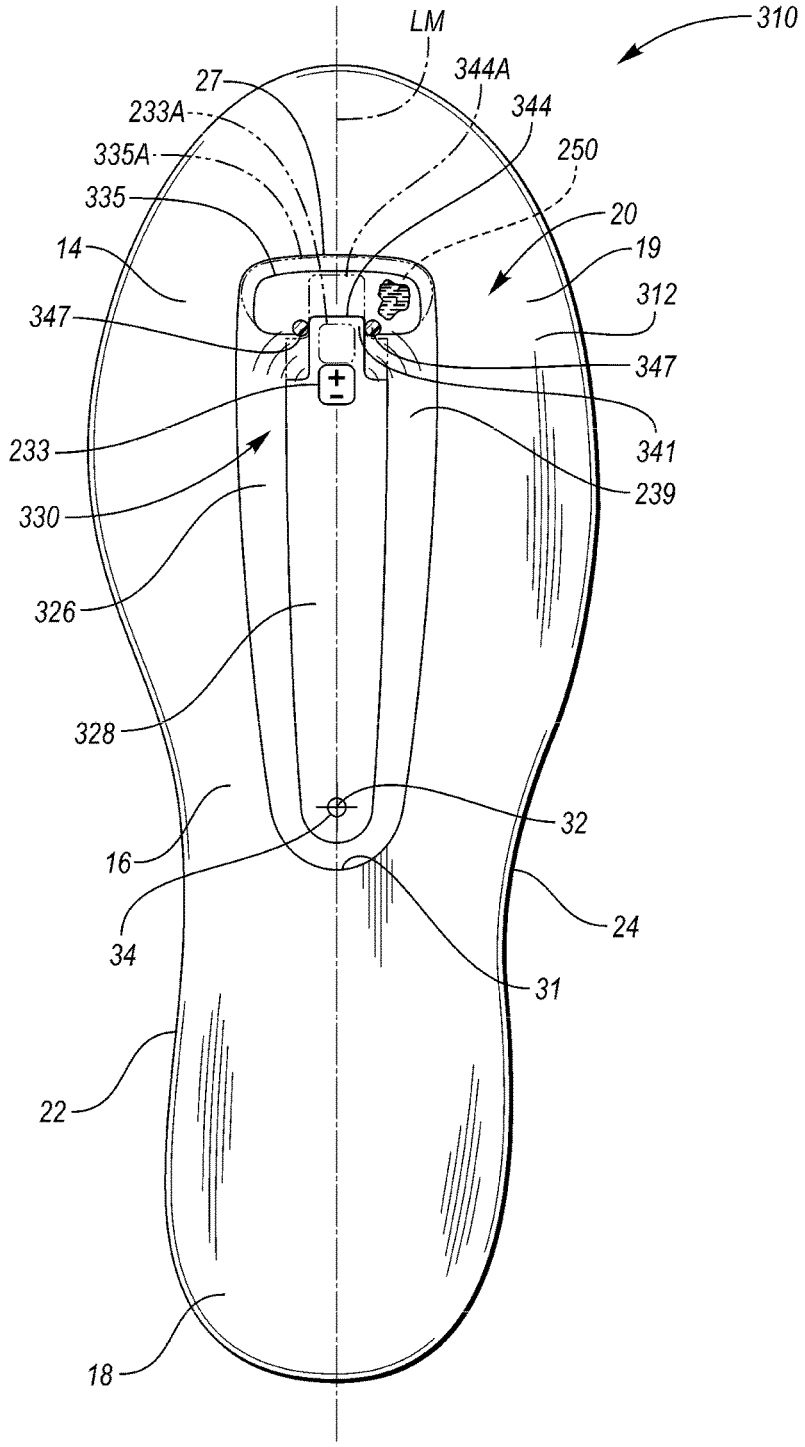
FIG. 15 is a schematic illustration in plan view of an alternative embodiment of a sole structure for an article of footwear with a piston and a cushioning system in an initial position, and showing a position of the piston during dorsiflexion in phantom.

FIG. 15 shows another embodiment of a sole structure 310 that can be used in place of sole structure 10 in the article of footwear 11. The sole structure 310 has many of the same components as the sole structures 10, 110, and 210. These components are referred to with identical reference numbers and function as described with respect to sole structures 10, 110, and 210. Like sole structure 210, the sole structure 310 includes a piston 328. The magnet 233 is secured to the piston 328. The sole structure 310 also includes a cushioning system 330 that includes a housing 335 containing the smart material fluid 250 described in FIG. 14. The fluid 250 fills the housing 235. Only a portion of the fluid 250 is shown for clarity in the drawings. Only the narrowed front portion of the piston 328 fits in the opening 341 and moves in the fluid 250 in the recess 326 when the piston 328 moves with dorsiflexion of the sole structure 310. The piston 328 and the cushioning system 330 are disposed in a recess 326 of the sole plate 312. Instead of a pocket, the housing 335 has an opening 341 surrounded by a seal 347. The forward end 344 of the piston 328 is received in the opening 341 and is surrounded by the seal 347 even when the sole structure 310 is in the initial position (i.e., the unflexed, relaxed state of FIG. 15). The piston 328 is anchored at anchor location 32 near a rear end, as described with respect to piston 28.

Repetitive dorsiflexion of the sole structure 310 causes the forward end 344 to be inserted further inside of the housing 335 through the opening 341 during dorsiflexion to the position 344A shown in phantom, and then to withdraw to the initial position shown in FIG. 15, oscillating back and forth between the two positions as the sole structure 310 is dorsiflexed and then plantar flexed with successive steps. The magnet 233 moves between the position shown and a forward position 233A as the piston 328 oscillates. The distance between the initial position and the final, forward position 344A can be selected to correspond with a desired flex angle at which maximum stiffness is desired.

The housing 335 deforms to fill any the gap that may exist forward of the housing 335 and rearward of the forward wall 27 of the sole plate 312 at the recess 326 as indicated by the phantom lines representing the deformed housing 335A. The forward end 344 is increasingly more difficult to move forward in the fluid 250 as the magnetic 233 and magnetic field 239 move closer to the fluid 250 during the dorsiflexion. Compressive forces of the sole plate 312 are applied on the piston 328 by the rear wall 31 at the recess 326 and by the more difficult to deform housing 235 due to the increased viscosity of the smart material fluid 250 preventing forward movement of the piston beyond the position 344A of the forward end. If the magnetic field 239 is sufficiently strong and the smart material fluid 250 has a sufficiently high viscosity, the piston 328 may be locked in the forward position 344A, such as to maintain a dorsiflexed position of the sole structure 310 during a race.

Figure 16:
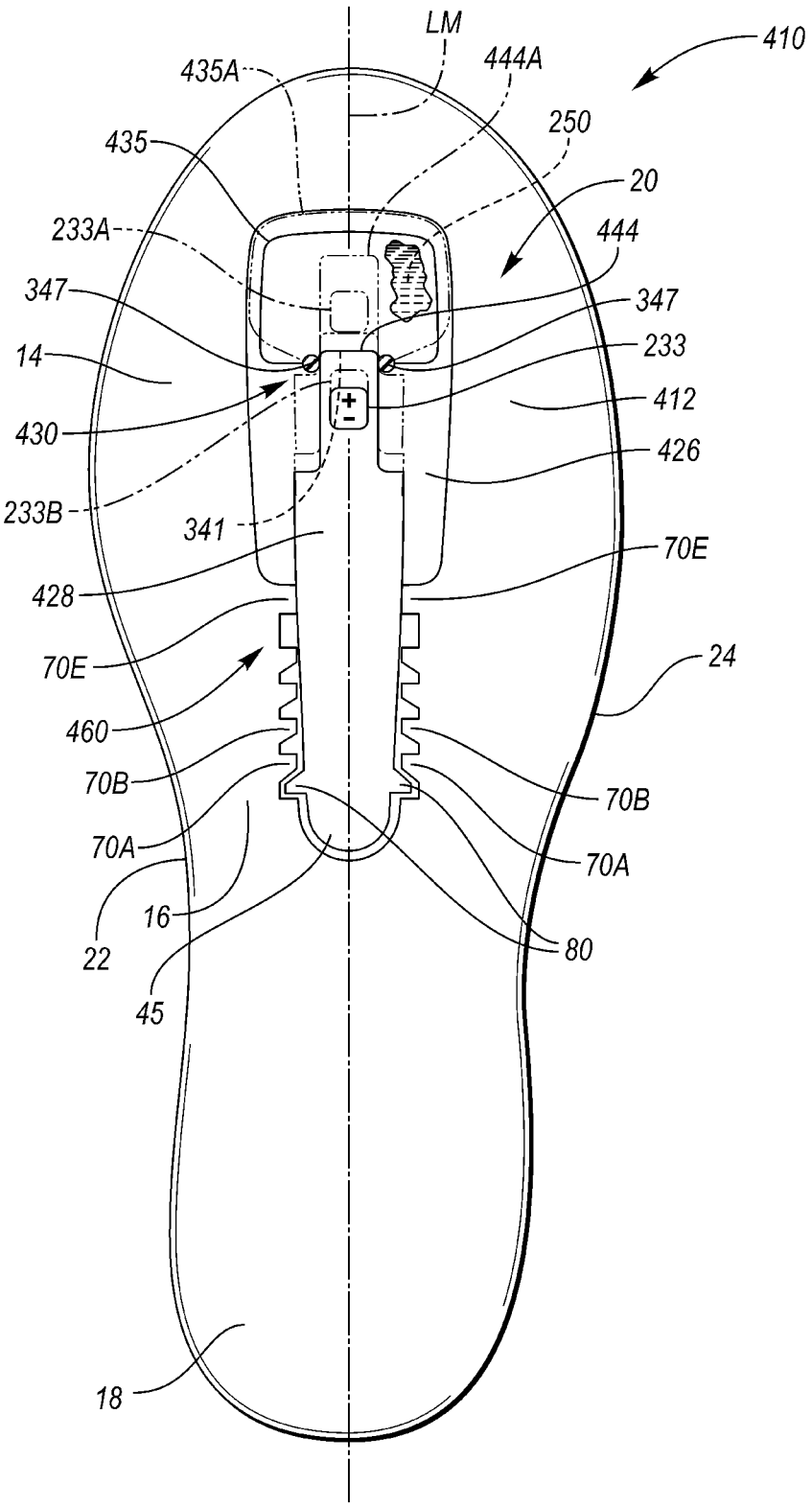
FIG. 16 is a schematic illustration in plan view of an alternative embodiment of a sole structure for an article of footwear with a piston and a cushioning system in an initial position, and showing a subsequent position of the piston in phantom.

FIG. 16 shows another embodiment of a sole structure 410 that can be used in place of sole structure 10 in the article of footwear 11. The sole structure 410 has many of the same components as the sole structures 10 and 310. These components are referred to with identical reference numbers and function as described with respect to sole structures 10 and 310. Like sole structure 310, the sole structure 410 includes a piston 428 with the magnet 233. The sole structure 410 also includes a cushioning system 430 that includes a housing 435, seal 347 and the smart material fluid 250. The piston 428 and the cushioning system 430 are disposed in a recess 426 of a sole plate 412. The forward end 444 of the piston 428 is received in the opening 341 and surrounded by the seal 347 even when the sole structure 410 is in the unflexed, relaxed state of the initial position of FIG. 16.

The piston 428 is not anchored to the sole plate 412 when it is in the initial position of FIG. 16. In response to repeated dorsiflexion of the sole structure 410, the unanchored forward end 444 of the piston 428 moves toward the cushioning system 430 from the initial, distal position of FIG. 16 to a final, proximate position 444A shown in phantom in FIG. 16. The rear end 45 of the piston 428 is also not anchored to the sole plate 412. In the initial position of FIG. 16, respective teeth 80 extend from both the medial side and the lateral side 24 of the piston 428. The sole plate 412 includes a guide track 460 that includes a tooth 70A extending from the sole plate 412 at either side of the recess 426. Each tooth 70A engages the respective adjacent tooth 80 as described with respect to tooth 80 and tooth 70A of FIG. 14. When the sole structure 410 is flexed in dorsiflexion, the teeth 80 slide over and past the teeth 70A. The teeth 70A are resiliently deformable under sufficient force to permit the teeth 80 to move forward over the teeth 70A in this manner.

Once the piston 428 has moved to the position in which the teeth 80 are forward of teeth 70A, the magnet 233 is in the position 233B, and parallel walls of the teeth 70A and the teeth 80 prevent backward movement of the teeth 80 over the teeth 70A, as discussed with respect to tooth 80 in FIG. 8. In a subsequent dorsiflexion, the teeth 80 slide over and past the next forward teeth 70B, 70C, 70D until blocking teeth 70E prevent further forward movement of the teeth 80, and the sole plate 412 effectively locks the forward end 444 of the piston 428 in the position 444A, with the magnet moved forward with the piston 428 to a position 233A shown in phantom. In the position 233A, the field 239 of the magnet 233 has a greater effect on the smart fluid 250 than in the initial position.

Repetitive dorsiflexion of the sole structure 410 causes the forward end 444 and the magnet 233 to oscillate fore and aft within the fluid 250 as the sole structure 410 is dorsiflexed with successive steps. The forward end 444 of the piston 428 stays within the housing 435 during the oscillation. Only the narrowed front portion of the piston 428 fits in the opening 341. Shoulders of the piston 428 adjacent the neck portion contact and deform the housing 435 forward against the forward wall of the sole plate 412 at the recess 426, and possibly against the lateral and medial side walls of the sole plate 412 at the recess 426, as indicated by the phantom lines representing the deformed housing 435A. The viscosity of the fluid 250 affects the stiffness of the sole structure 410 during this repetitive dorsiflexion, requiring more torque for the piston 428 to move within the fluid 250 and to deform the housing 335. If the magnetic field 239 and the smart material fluid 250 are sufficiently strong, the piston 428 may be locked in the forward position 444A rather than oscillate within the fluid 250.

Figure 17:
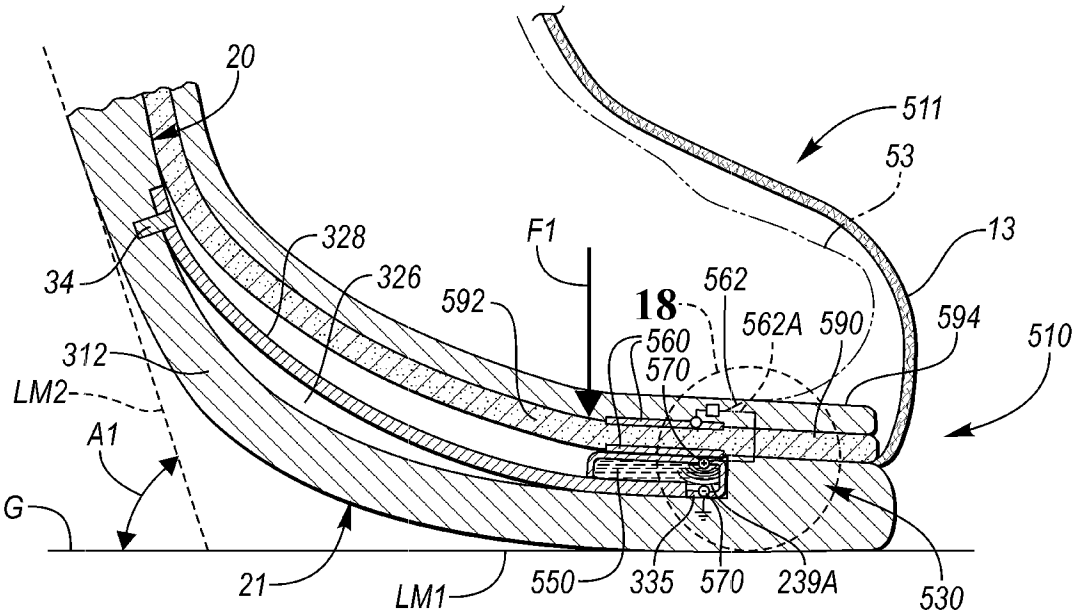
FIG. 17 is a schematic illustration in cross-sectional fragmentary side view of an alternative embodiment of a sole structure for an article of footwear in dorsiflexion.

FIG. 17 shows another embodiment of a sole structure 510 in an article of footwear 511. The sole structure 510 has many of the same components as sole structure 310, such as the same sole plate 312 with recess 326, piston 328, a housing 335, and seal 347. The sole structure 510 has a cushioning system 530 that includes a smart material fluid 550 contained in the housing 335. The smart material fluid 550 is an electrorheological fluid rather than a magnetorheological fluid. Accordingly, there is no magnet on the piston 328. The sole structure 510 is shown in cross-section taken along a longitudinal midline, similar to longitudinal midline LM of FIG. 15. Identical components are referred to with identical reference numbers and function as described with respect to sole structures 10, 110, 210, 310, and 410.

The sole structure 510 also has an additional sole component 590 proximate the cushioning system 530. More specifically, the additional sole component 590 may be a sole layer that overlays and is secured to the foot-facing surface 20 of the sole plate 312. The sole component 590 comprises a piezoelectric material 592 that produces a voltage captured by a capacitor 560 when the sole component 590 is compressed. The piezoelectric material 592 is represented as shaded particles dispersed throughout the sole component 590, such as dispersed throughout a foam base material of the sole component 590. A sockliner 594 may extend over sole component 590.

The downward force A1 of the foot 53 on the forefoot region of the sole component 590 (through the sockliner 594) during dorsiflexion compresses the sole component 590 sufficiently to activate the piezoelectric material 592, creating a voltage across the material. The voltage is sufficient to briefly activate the smart material fluid 550 if allowed to discharge, thereby increasing the viscosity of the smart material fluid 550, and the resistance to movement of the piston 328 with dorsiflexion of the sole structure 510.

Figure 18:
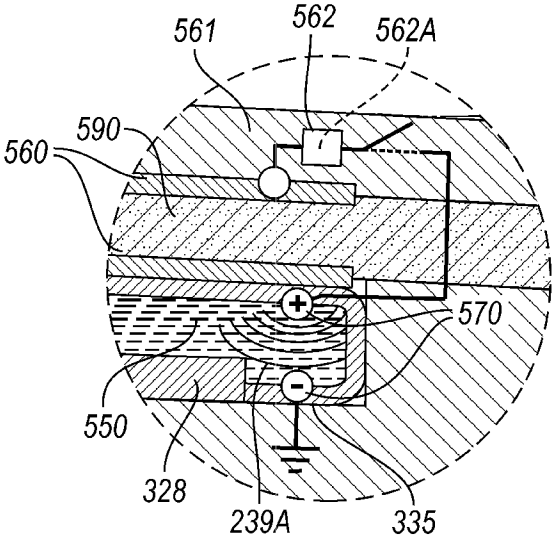
FIG. 18 is a schematic illustration in cross-sectional fragmentary side view of a portion of the embodiment of FIG. 17.

In the embodiment shown, rather than allowing the voltage created across the piezoelectric material 592 with each dorsiflexion to quickly discharge, the cushioning system 530 includes a conditioning system 561 in series with the capacitor 560 and a switch 562, best shown in FIG. 18. The capacitor 560 is operatively connected to the piezoelectric material 592 to receive the voltage which is then stored in a component (such as a battery or capacitor) of the conditioning system 561. A switch 562 is in series with the conditioning system 561. Electrodes 570 are exposed to the fluid 550 as shown, or to optional conductors positioned inside the housing 335 and exposed to the fluid 550. A bottom plate of the capacitor 560 and the lower electrode 570 are grounded. When the stored energy reaches a predetermined level, the switch 562 moves from the open position shown to a closed position 562A shown with dashed lines to connect the conditioning system 561 to the electrodes 570, enabling the stored energy to discharge across the smart material fluid 550, as indicated by electric field 239A, increasing the viscosity of the smart material fluid 550 and the resistance to movement of the piston 328 against the housing 335 and/or within the fluid 550. Bending stiffness of the sole structure 310 is therefore increased, and greater torque is required to reach the flex angle A1 than if the switch 562 is in the open position and the capacitor 560 is not discharged. The rate of discharge can be controlled by the conditioning system 561, as is understood by those skilled in the art, so that the increased stiffness will have an effect over a number of subsequent dorsiflexions.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:
a sole plate having a foot-facing surface;
a piston disposed on the sole plate at the foot-facing surface; and
a cushioning system disposed on the sole plate and having a variable cushioning characteristic;
wherein the piston contacts the cushioning system to deform the cushioning system when the sole plate is dorsiflexed and the variable cushioning characteristic varies in response to dorsiflexion of the sole plate.

2. The sole structure of claim 1, wherein:
the piston is fixed to the sole plate at an anchor location; and
an unanchored end of the piston disposed between the anchor location and the cushioning system reciprocates toward and away from the cushioning system in response to repeated dorsiflexion of the sole plate.

3. The sole structure of claim 1, wherein:
the sole plate has a guide track; and
the piston engages with the guide track and ratchets incrementally along the guide track in response to repeated dorsiflexion of the sole plate.

4. The sole structure of claim 1, further comprising:
a rack secured to the cushioning system;
wherein the piston engages with and incrementally ratchets along the rack in response to repeated dorsiflexion of the sole plate; and
wherein the cushioning system is moved relative to the piston via the piston ratcheting along the rack.

5. The sole structure of claim 4, wherein:
the rack includes a series of teeth; and
the piston includes a protrusion that engages each tooth of the series of teeth in succession as the piston incrementally ratchets along the rack.

6. The sole structure of claim 4, wherein:
the variable cushioning characteristic is a hardness of the cushioning system;

the cushioning system includes a dual-density foam cushioning component that has a first portion with a first hardness and a second portion with a second hardness different than the first hardness;

the hardness of the cushioning system is dependent on a length of the first portion along a longitudinal midline of the sole plate forward of the piston and a length of the second portion along the longitudinal midline of the sole plate forward of the piston; and the length of the first portion along the longitudinal midline of the sole plate forward of the piston and the length of the second portion along the longitudinal midline of the sole plate forward of the piston vary according to a position of the cushioning system relative to the piston.

7. The sole structure of claim 6, wherein the rack and the cushioning system are configured so that the cushioning system moves transversely relative to the piston in response to dorsiflexion of the sole plate.

8. The sole structure of claim 7, wherein:

the first portion increases in length in a forward longitudinal direction from a lateral side of the cushioning component to a medial side of the cushioning component; and the second portion decreases in length in the forward longitudinal direction from the lateral side of the cushioning component to the medial side of the cushioning component.

9. The sole structure of claim 1, wherein the cushioning system includes at least one of:

a dual-density foam;

a polymeric bladder element enclosing a fluid-filled interior cavity; or a smart material.

10. The sole structure of claim 1, wherein:

the sole plate has a recess at the foot-facing surface; and the piston and the cushioning system are disposed in the recess.

11. A sole structure for an article of footwear comprising:

a sole plate having a foot-facing surface;

a piston disposed on the sole plate at the foot-facing surface; and a cushioning system disposed on the sole plate and having a variable cushioning characteristic;

a rack secured to the cushioning system;

wherein the piston engages with and incrementally ratchets along the rack in response to repeated dorsiflexion of the sole plate;

wherein the piston contacts the cushioning system to deform the cushioning system when the sole plate is dorsiflexed and the variable cushioning characteristic varies in response to dorsiflexion of the sole plate; and wherein the cushioning system is moved transversely relative to the piston via the piston ratcheting along the rack.

12. The sole structure of claim 11, wherein the rack is an elongated, flexible strap.

* * * * *